US005711423A

United States Patent [19]

Fuller, Jr.

[11] Patent Number: 5,711,423

[45] Date of Patent: Jan. 27, 1998

[54] PACKAGE CONTAINER WITH WASTE DISPOSAL COMPARTMENT

[76] Inventor: Arthur G. Fuller, Jr., 886 Decatur Ave., Ventura, Calif. 93004

[21] Appl. No.: 800,501

[22] Filed: Feb. 14, 1997

Related U.S. Application Data

[63] Continuation of Ser. No. 549,261, Oct. 27, 1995, abandoned.

[51] Int. Cl.[6] ..... B65D 85/10

[52] U.S. Cl. ..... 206/246; 206/259; 206/267; 220/534; 220/546

[58] Field of Search ..... 206/242, 246, 206/248, 256, 259, 264, 267, 85, 89, 91, 94, 817; 220/532, 533, 534, 544, 545, 546; 131/231, 238, 329, 174, 175

[56] References Cited

U.S. PATENT DOCUMENTS

| | | | |
|---|---|---|---|
| 1,499,054 | 6/1924 | Ford | 206/246 |
| 1,840,664 | 1/1932 | Gerstheimer | 206/246 |
| 2,058,710 | 10/1936 | Montgomery | 206/246 |
| 2,316,295 | 4/1943 | Shaw . | |
| 2,435,826 | 2/1948 | Greene . | |
| 2,585,923 | 2/1952 | Epler et al. | 206/246 |
| 2,764,984 | 10/1956 | Cohen et al. | 206/246 |
| 3,096,878 | 7/1963 | Whitley et al. . | |
| 3,451,533 | 6/1969 | Butler . | |
| 4,252,237 | 2/1981 | Baclit . | |
| 4,961,496 | 10/1990 | Focke et al. . | |

*Primary Examiner*—Paul T. Sewell
*Assistant Examiner*—Luan K. Bui
*Attorney, Agent, or Firm*—Kenneth J. Hovet

[57] ABSTRACT

A container is provided for a collapsible package of wrapped and/or consumable items. The container comprises an outer housing having a movable inner partition that divides the interior into a waste compartment and a package receptacle area. As the packaged items are removed, the partition is moved against the package causing it to collapse and become reduced in size. The amount of reduction results in a concomitant increase in size of the waste compartment. The partition may be an integral part of a sleeve structure having side panels with grip members accessible through openings in the housing walls. The housing is at least partially enclosed with a movable top cover which may include a waste opening and movable lid.

17 Claims, 5 Drawing Sheets

PACKAGE CONTAINER WITH WASTE DISPOSAL COMPARTMENT

This application is a continuation of application Ser. No. 08/549,261, filed Oct. 27, 1995, now abandoned

BACKGROUND OF THE INVENTION

1. Field of the Invention

The present invention relates to multi-compartmented containers. More particularly, the invention pertains to containers having movable interior parts to effect variable sized compartments.

2. Description of Related Art

With the increasing awareness about the importance of the environment, consumers are looking for ways to avoid litter and to recycle products comprised of recyclable materials. Particularly with respect to cigarettes, it is desirable to extinguish the cigarette quickly after use to minimize the production of cigarette smoke. It is also desirable to provide a safe repository for cigarette butts without fear of igniting a fire or littering the environment. A carelessly discarded cigarette has the potential for causing extensive damage in lives and property as being a source for fire.

Efforts to alleviate the above are manifested in certain U.S. patents. For example, U.S. Pat. No. 2,058,710 describes a matchstick-type container having a partitioned inner drawer. The partition divides the drawer into a cigarette package area and a cigarette disposal area. Access to either area is effected by simply sliding the drawer out one end or the other of an open-ended housing.

A problem with the above container is its fixed partition. This requires the container to have sufficient length to encompass two fixed area chambers. One area is sized to accommodate an entire package of cigarettes. The other area has a predetermined size to enclose ashes and cigarette butts.

In U.S. Pat. No. 3,096,878, a container for a cigarette package is provided which includes an ashtray in its bottom portion. The ashtray comprises a single sheet of material which has been folded into multiple panels to produce an accordion-like structure. As the pack of cigarettes is pulled outwardly from the container, the false bottom will travel with the package and partially open up the folded material. The channels between folds provide spaces for cigarette ashes. Access is provided through an opening in the side of the container.

A problem with the above design is that it cannot accept cigarette butts. Further, the folds are open to a portion of the package. This construction creates the potential for a fire hazard from hot ashes. Still further, the ashes must be discarded after every use in order to fully collapse the folded ashtray portion.

In U.S. Pat. No. 4,252,237, a multi-compartmented housing is provided that includes a cigarette lighter compartment, a match compartment and an ash compartment. The ash compartment is provided with a metal insert for extinguishing a lit cigarette and a chamber for retaining the cigarette ashes and butts.

While the above design is all encompassing, its bulk, weight and size militate against it becoming a convenient commercially viable item. In fact, it is depicted as having a belt clip suggesting that it is not suitable for placement in a shirt pocket or purse.

SUMMARY OF THE INVENTION

The present invention overcomes the disadvantages of the prior art by providing a container that is not much larger than a package of cigarettes. Consequently, it can be used and stowed in the same manner as a pack of cigarettes. This is very important to a smoker and constitutes a significant attribute of the invention.

Also, the compact container of the invention has interior chambers that can vary in size in relation to the amount of items that are removed therefrom. With respect to cigarettes, the container width need only be about one-fifth larger than the width of a cigarette package. Yet it can still hold all the ashes and cigarette butts from a full package.

Within the container is an enlargable waste compartment which provides a waste disposal means and a place for the extinguishment and containment of cigarette butts/ashes. The container also provides a contractible package receptacle area for enclosing and collapsing a package.

In operation, as cigarettes or other consumable items are removed from their package, the package size may be reduced with a movable partition and transport means. This action simultaneously expands the waste compartment. In this way, without auxiliary compartments or unnecessary structure, the container of the invention permits the containment of discardable wrappings, ashes and butts from an entire package.

The above is accomplished through the use of an outer housing having an interior partition which is movable in response to the change in contents of the package. Transport means for manually collapsing the package is included with the partition. A retention means may also be used for holding the partition against the package and maintain the package in a contracted state.

A housing top cover is provided to enclose at least the waste disposal area of the housing which is created by the partition. The cover is moved to permit access to the package receptacle area and/or the waste compartment. The cover may be provided with a waste opening which itself is enclosed with a lid. Either way, waste materials, wrappers, cigarette ashes and butts may be safely discarded and any live coals will be quickly snuffed in the enclosed compartment.

DESCRIPTION OF THE PREFERRED EMBODIMENTS

Figure 1:
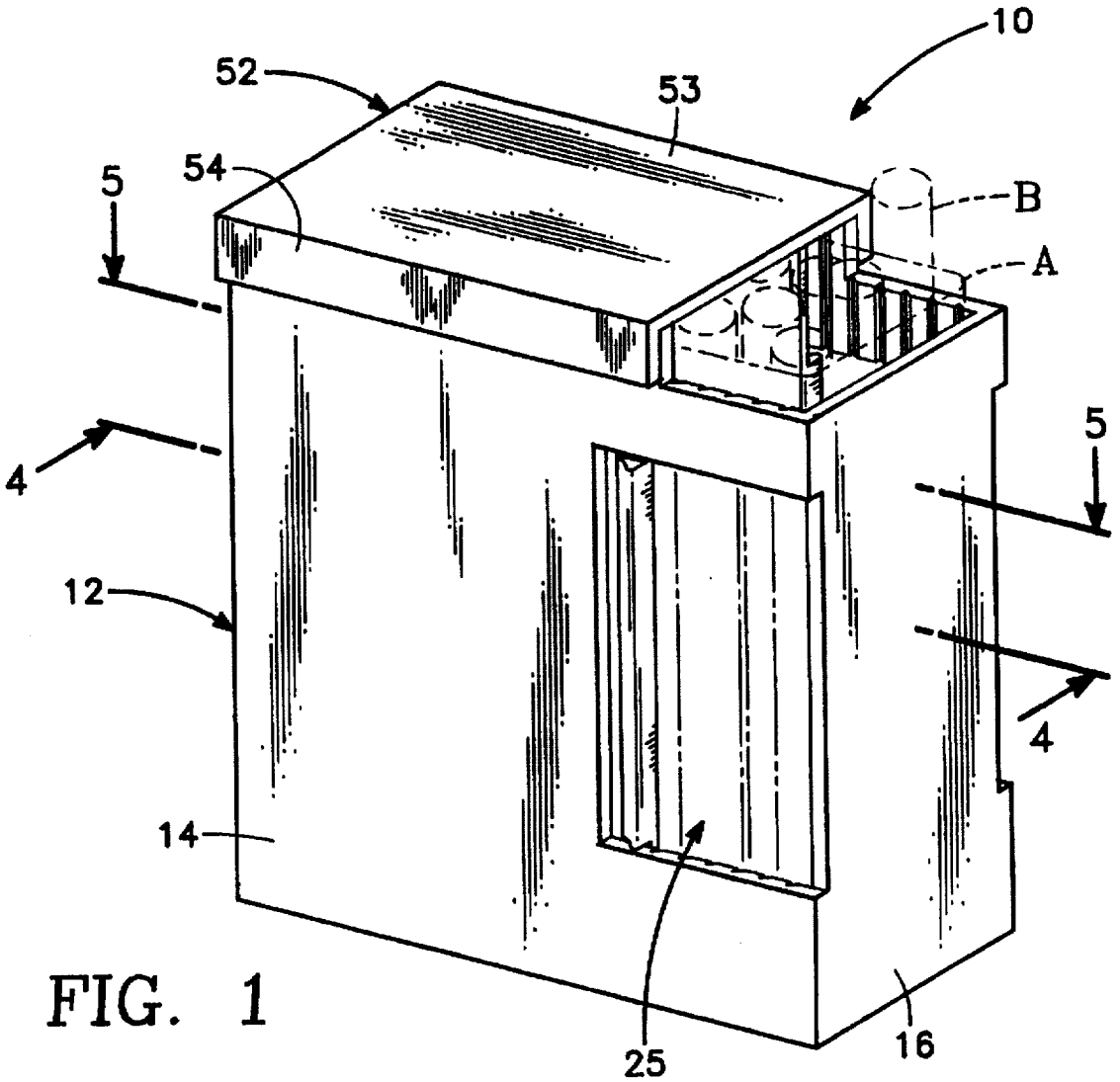
FIG. 1 is a left side front end perspective view of the overall container of the present invention.
Figure 2:
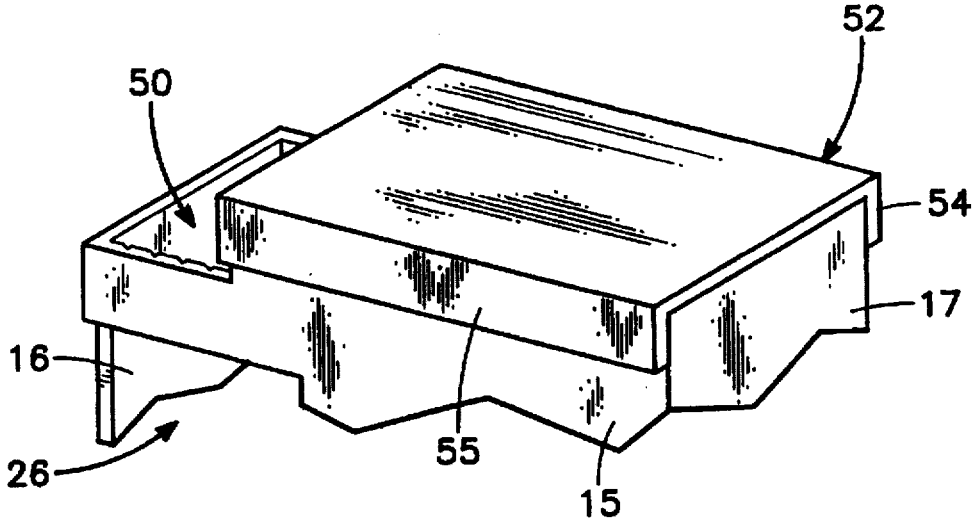
FIG. 2 is a fragmentary perspective view showing the upper portion of FIG. 1 from the right side back end of the container.
Figure 3:
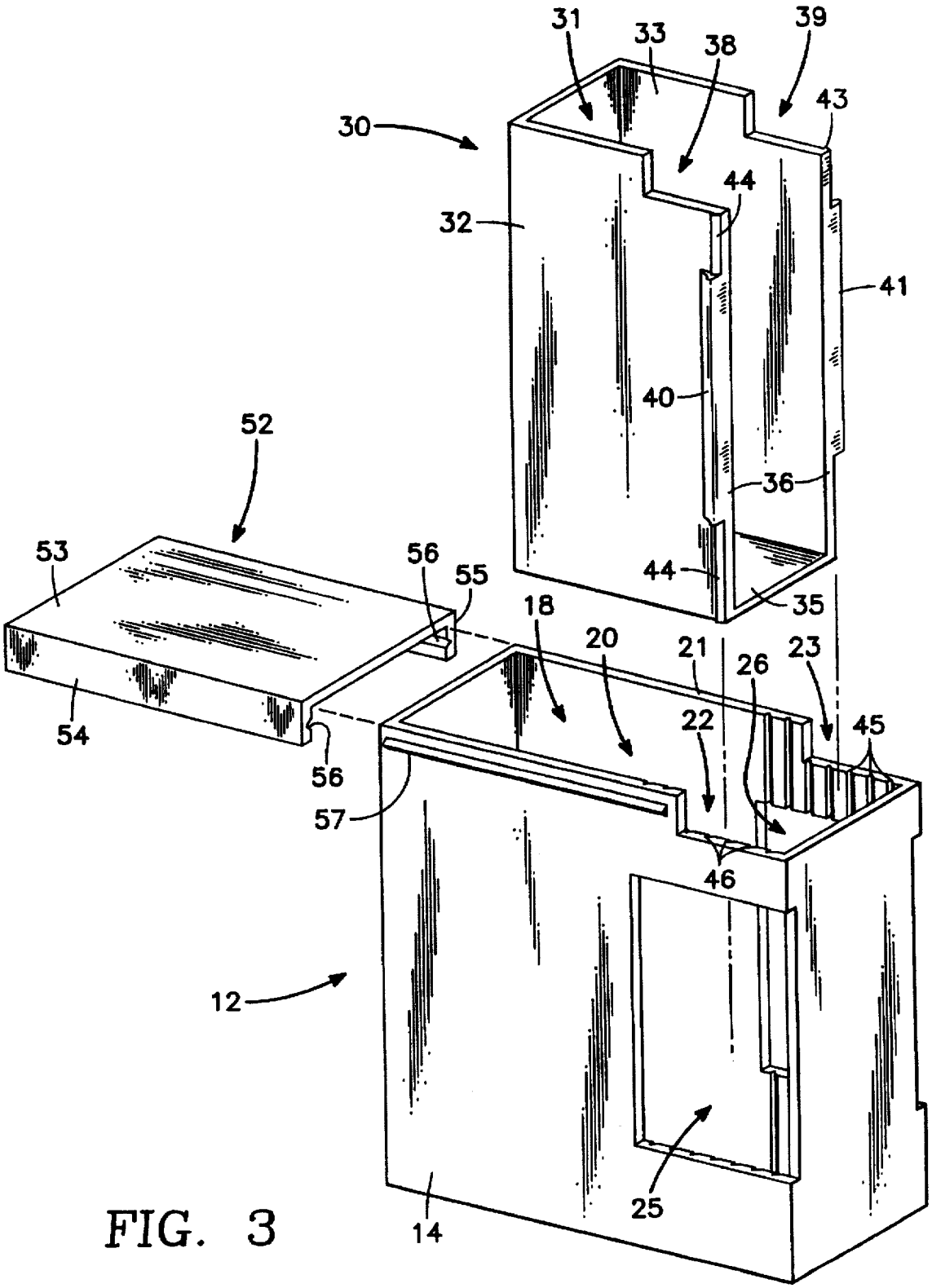
FIG. 3 is an exploded view of the container of FIG. 1.
Figure 4:
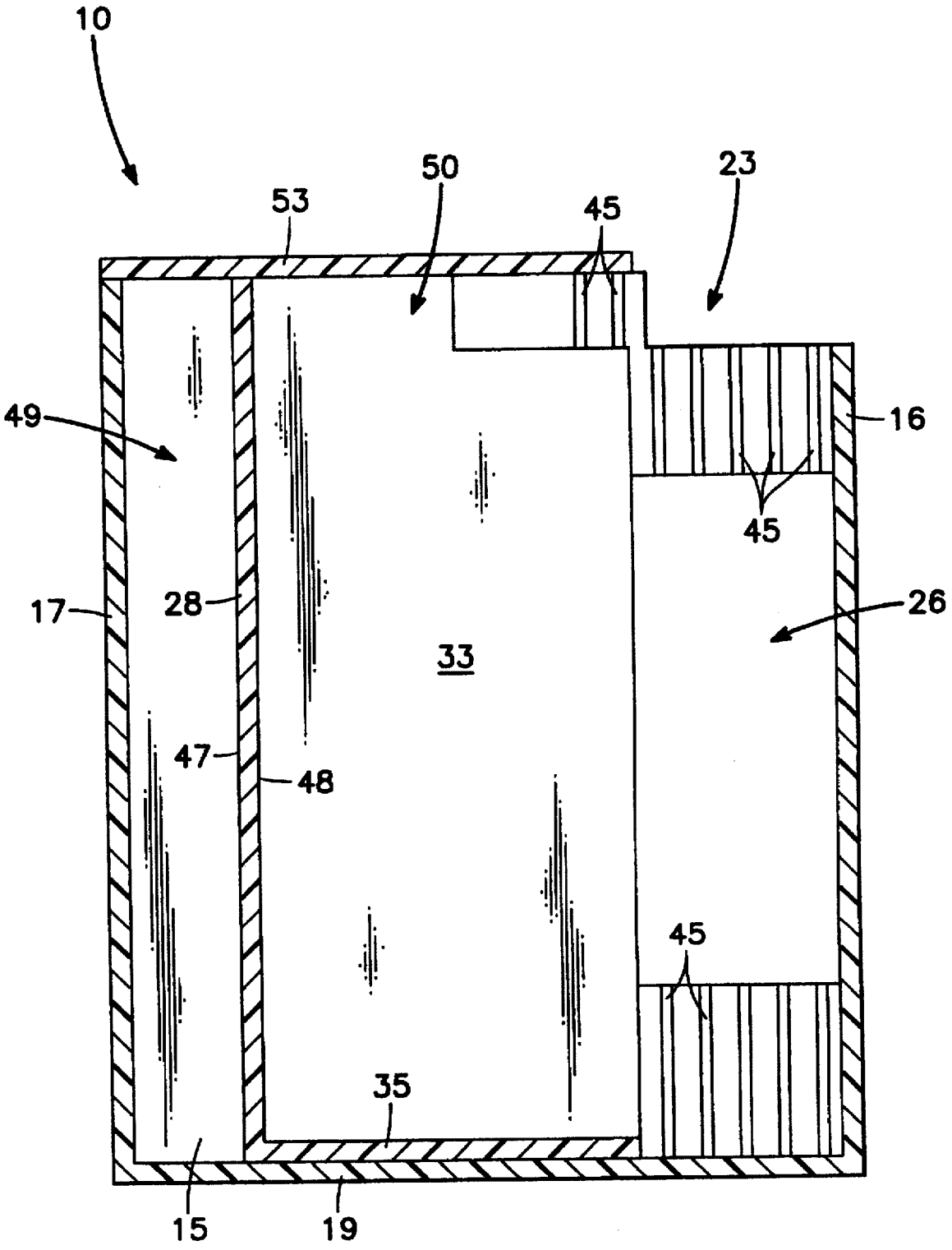
FIG. 4 is cross sectional view taken along lines 4—4 of FIG. 1.
Figure 5:
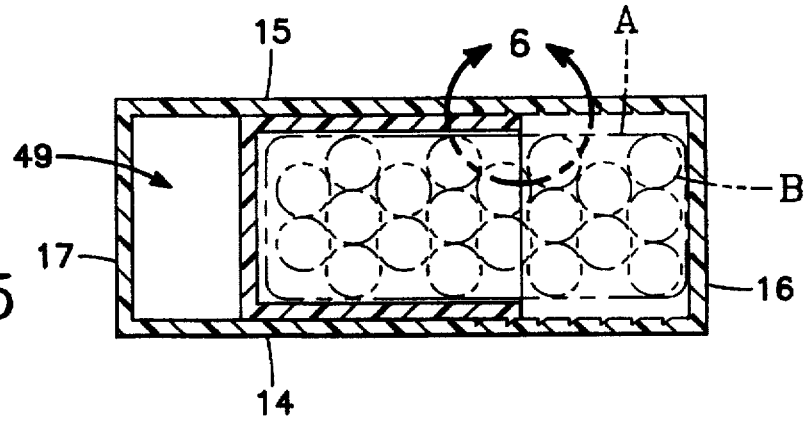
FIG. 5 is a cross-sectional view taken along lines 5—5 of FIG. 1.

With reference now to the drawings and more particularly to FIGS. 1–4 thereof, the overall container of the invention is shown by reference 10. A basic component of the container is housing 12. The particular size and geometrical shape of the housing will be dictated by the package being contained therein. When used with a cigarette package, a rectangular-shaped housing is displayed which conforms to the shape of a conventional package of twenty cigarettes. In such case, the width of the housing will exceed the width of a package of cigarettes by an amount no less than the diameter of a cigarette. As depicted in FIG. 1, an imaginary package is shown by reference A and cigarettes are shown by reference B.

The housing consists of opposing side walls 14,15 which interconnect with front end 16, back end 17 and bottom wall 19. The above walls circumscribe an open top 18 and define an overall housing interior 20.

The forward upper end portion of the housing may be provided with notched portions 22,23. This is for convenience purposes to permit easier access to the contents of a package to be contained therein. It is expected that the maximum height of the housing will be commensurate with the height of a king-size package of cigarettes. The horizontal edge of the notched portions will have less height to facilitate access to a regular size package of cigarettes.

The forward mid portion of both the left and right side walls 14,15 are provided with respective grip openings 25,26. Although the grip openings are shown as being rectangular in-shape and extending from front end 16 rearward, the shape and location are matters of choice dictated by aesthetics and for purposes to be hereinafter described. It is preferred that the respective pairs of notched portions and grip openings be identical in shape and coextensive for each of the opposing side walls. In this way, the walls will be mirror images of each other.

Interfitted inside housing interior 20 is a partition 28. With reference to the FIGS. 1–7 embodiment, the partition is a flat panel which is sized to fit closely to the cross-sectional shape of interior 20. It has a height that is coextensive with the maximum height of side walls 14,15 and includes an outer face 47 and an inner face 48.

The partition may stand alone and be supported by corresponding grooves on the inside surfaces of walls 15,16. However, in the preferred embodiment shown, the partition is supported by an integral sleeve structure 30. The sleeve is constructed of opposing left and right side panels 32,33 extending upwardly from bottom panel 35. Interconnecting each of the above panels from the back end of the bottom panel is the partition 28. This construction results in an overall sleeve structure that is open at its top and is also open across its front.

Along the forward end of each side panel is a grip means shown as grip members 40,41. Each grip member comprises a rib extending outwardly from the middle portion of each corresponding panel into a respective grip opening 25,26. This arrangement facilitates manual movement of the sleeve in a manner to be described. Also, by locating the grip members at the forward ends of the side panels, partition 28 will be positioned at its rearwardmost position. This will maximize the area in front of the partition. It will be appreciated that the location, size and shape of the grip members will, in part, be dictated by the package being contained including the location and configuration of the grip openings 25,26.

It is preferred that the upper forward end of each side panel have a cut-out corner 37,38. The size and configuration of each cut-out should be about identical to notched portions 22,23. In this way, when the sleeve is in its forewardmost position, the cut-out corners and notched portions will be coextensive.

The outer surface of the leading edge of each side panel also includes an outwardly extending panel flange 43,44. Portions of the panel flange preferably extend both above and below the centrally located grip members. They engage corresponding vertical serrations 45,46 on the interior surfaces of sidewalls 14,15.

Figure 6:
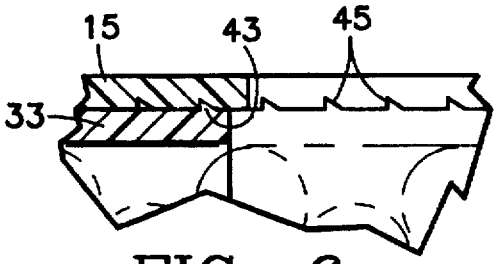
FIG. 6 is an enlarged fragmentary view taken along line 6 of FIG. 5.
Figure 7:
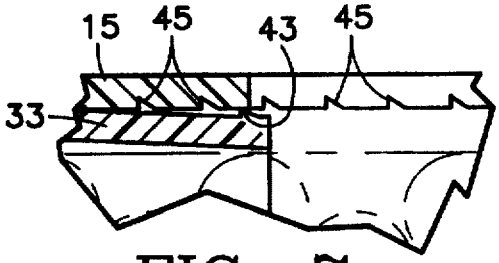
FIG. 7 is a view similar to FIG. 6 showing deflection of a sleeve side wall during axial movement of the sleeve.

The serrations are shown as being located in the front portions of the sidewalls. However, when partition 28 is used alone and is not part of the sleeve, the serrations will be located in the back half of the sidewalls. As so disposed, the serrations will support the partition and allow it to be positioned in multiple locations within interior 20. A more detailed view of the serrations and panel flanges are shown in FIGS. 6 and 7 of the drawings.

The purpose of the partition is to divide the housing interior into a waste compartment 49 and a package receptacle area 50. The waste compartment is defined by the space between outer face 47 of the partition, the back end 17 of the housing, and a portion of bottom wall 19.

The package receptacle area is, for the most part, defined by the interior 31 of the sleeve. However, it is expected that the width of side panels 32,33 will be less than the width of a package to be contained therein. Thus, a portion of the package will extend outwardly from the sleeve a predetermined distance. Preferably, this distance will be less than one-third the width of the package. Therefore, the package receptacle area will be defined by the forward portion of interior 20 not occupied by the sleeve plus interior 31 of the sleeve.

As previously indicated, the volume of the waste compartment and the package receptacle area will vary in size in accordance with movement of the partition. This feature will be described in more detail with respect to operation of the container.

Figure 8:
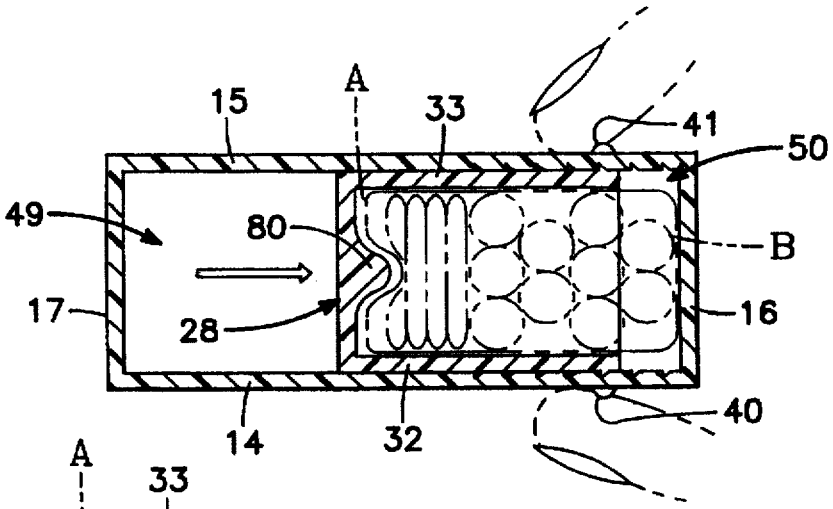
FIG. 8 is a cross-sectional view similar to FIG. 5 showing a rounded projection part collapsing the end of a cigarette package as a user is drawing the sleeve toward the front end of the container.
Figure 9:
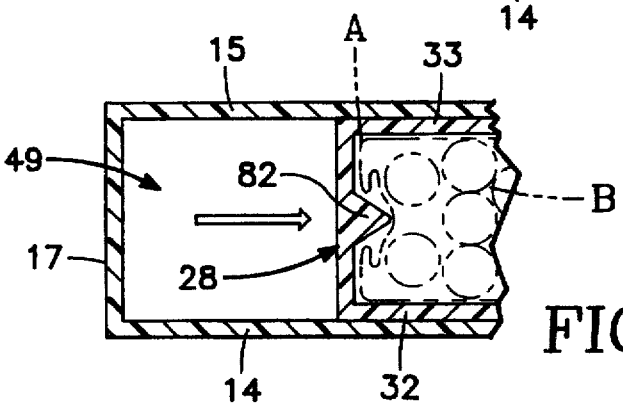
FIG. 9 is a fragmentary view similar to FIG. 8 showing an angular projection part creasing the end of a cigarette pack.

Alternative embodiments of sleeve 30 are depicted in FIGS. 8 and 9. In these embodiments, the partition 28 is provided with an abutment means for engaging a collapsible package contained in the package receptacle area. As shown in FIG. 8, a rounded projection part 80 is depicted for engaging an end of a cigarette pack. When the partition is moved forward, the projection part will initiate a crease into the end of the pack. The crease, in turn, facilitates the inward collapse of the cigarette package.

FIG. 9 illustrates an abutment part 82 having a pointed geometric configuration. This configuration may be more appropriate for stiff packaging materials. In either case, the projection part may be an integral part of the partition or it may comprise a detachable structure. The overall length of each part is preferably about equal to the height of the partition. At a minimum, it should be at least one-half the height of the partition.

Top cover 52 overlies at least that portion of open top 18 that is coextensive with the waste compartment. The top cover may be hinged, pivoted or include slide means to accomplish its engagement to the top of the housing. In the basic embodiment shown in FIGS. 1–5, it comprises a U-shaped member having a flat top wall 53 with opposing downwardly depending cover flanges 54,55.

The inside surfaces of each cover flange is provided with an inwardly facing longitudinal groove 56. The grooves extend throughout the length of each flange. They are sized to engage corresponding longitudinal runners extending along the outside top end portion of opposing left and right sidewalls 14,15.

The top cover is open-ended so that when the grooves are engaged with the runners, the cover may be slid in either direction. The grooves and runners are offset below open top edges 21 and coact in a manner to permit sliding movement of the cover while maintaining a snug fit against the top edges. In this way, with respect to hot ashes or cigarette butts, any burning material will be extinguished for lack of oxygen.

In the embodiments shown, the top cover extends from back end wall 17 to the outer corners of notched portions 22,23. This length entirely encloses the waste compartment and a portion of the package receptacle area. In regard to use of the container for a pack of cigarettes, the above length is preferred because it provides unimpeded access to a fresh cigarette as depicted in FIG. 1.

When the container is used with another type of package wherein it is important to keep the package closed, the notch portions can be eliminated and the cover can be extended to front end wall 16. If the package contents need to be sealed, the open top edges 21 and cover underside my include sealing means such as resilient gaskets, deflectable sealing flanges or additional overlapping joint engagement structures known in the art.

Figure 10:
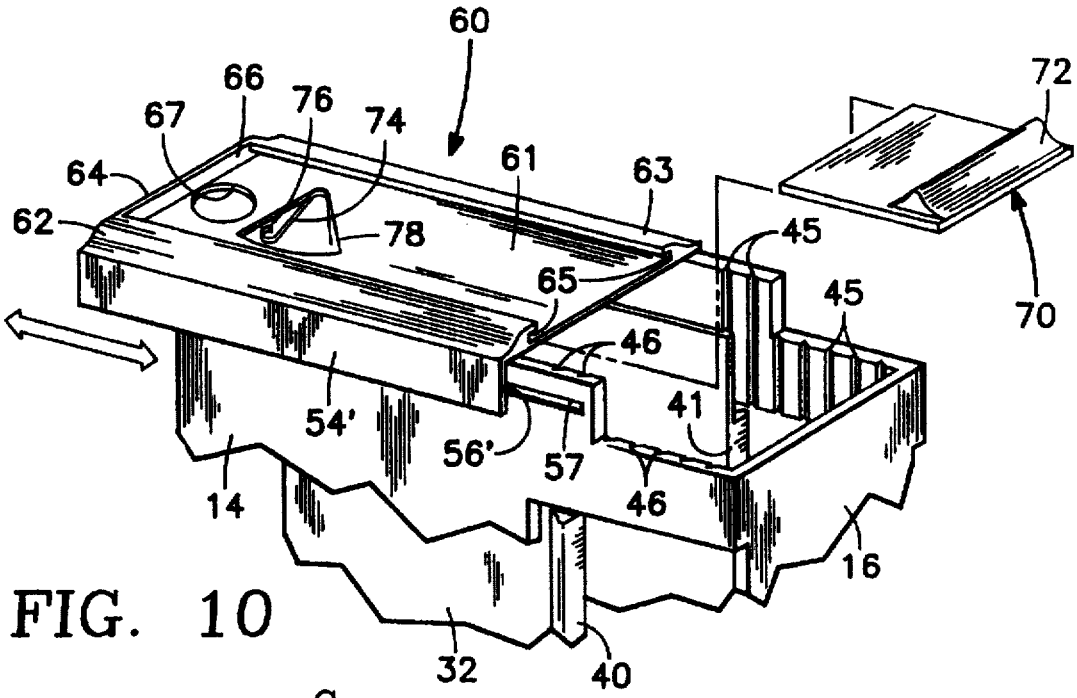
FIG. 10 is a left side front end fragmentary perspective view of the container of FIG. 1 showing an alternative cover with a lid exploded therefrom.
Figure 11:
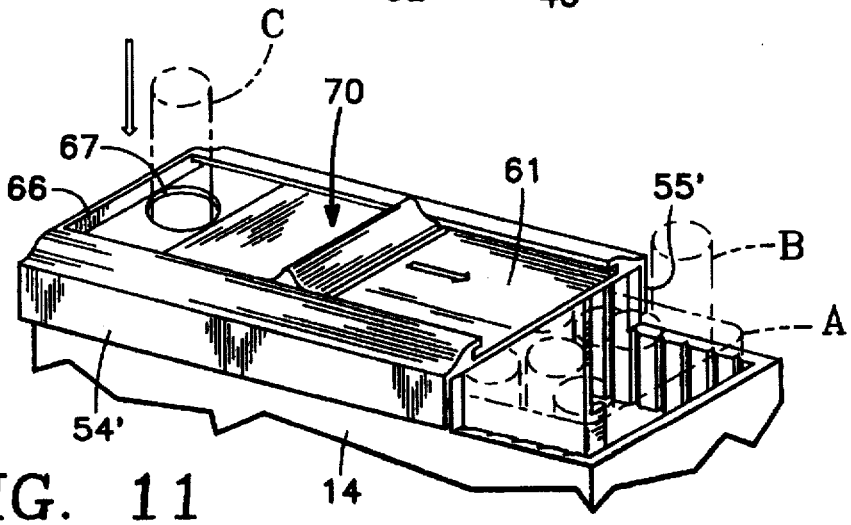
FIG. 11 is a view similar to FIG. 10 with the lid assembled to the cover and showing operation of the lid when discarding a cigarette butt.
Figure 12:
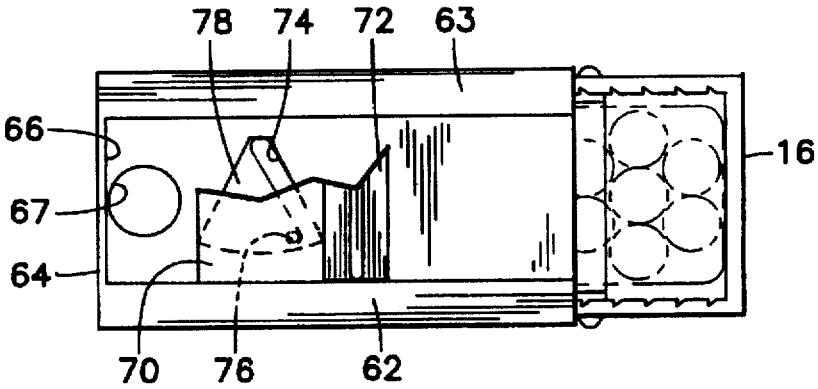
FIG. 12 is a top plan view of the container shown in FIG. 11 with a fragmentary view of the lid showing deflection of a lid spring.

FIGS. 10–12 show an alternative lid cover 60. This cover includes all the elements of U-shaped top cover 52. It includes opposing downwardly depending flanges 54',55' having longitudinal inner grooves 56'. Its upper surface 61 is provided with upwardly and inwardly inclined edge parts 62,63 defining inwardly facing channels 65.

An end flange 64 extends across the lid cover rear end and depends downwardly in a manner coextensive with flanges 54',55'. This prevents the lid cover from moving forwardly to expose the waste compartment. Note, however, that the forward end of the lid cover is open. This, of course, permits rearward movement of the lid cover. The end flange also extends upwardly above upper surface 61 to provide a lid abutment face 66 in a manner to be described.

In its closed position, the lid cover extends from back end wall 17 to the outer corners of sidewall notch portions 22,23. In the same manner as with top cover 52, this is a matter of choice to provide ready access to the package contents. As explained above, the cover could extend over the entire package receptacle area and provide protection for the enclosed contents. In this case, both the housing notched portions and sleeve cut-out corners would be omitted.

At its rearward end portion, the lid cover is provided with a waste opening 67. When the lid cover is in a closed position, the opening provides access to the waste compartment. In the preferred embodiment, the opening is circular and is sized slightly larger than the diameter of a cigarette. This permits passage of a cigarette butt C as depicted in FIG. 11.

To close opening 67, a movable lid 70 is provided. The lid comprises a flat structure having a width that corresponds to the distance between opposing channels 65. In this way, the peripheral edges of the lid will engage the channels and slide over the upper surface of the lid cover. The aforementioned lid abutment face 66 provides a stop for the lid after it completely overlies opening 67.

For convenience, the lid is provided with an upstanding rib part 72. As shown the rib part extends across an end of the lid. Its length is slightly less than the span between the distal ends of edge parts 62,63. This facilitates alignment of the lid as it moves along channels 65.

The lid my also be provided with an optional biasing means to maintain it in a closed position over the opening. With reference to FIGS. 10 and 12, the biasing means comprises a bent spring strip 74 which is mounted within recess 78 of the upper surface 61. One end of the spring strip is anchored to the recess and the free end of the spring is provided with a pivot 76. The pivot engages the underside of the lid for transmitting the spring biasing force to the lid for purposes of maintaining it in a closed position. This action will facilitate the extinguishment of any burning materials by depriving the waste compartment of oxygen.

With regard to the cigarette package shown by reference A, it will be appreciated that as cigarettes are removed from the package, a void will be created in the package. Because partition 28 is movable fore and aft relative to the container front and back end walls, the void can be eliminated and the volume of the waste compartment would be increased. This is accomplished by manually grasping grip members 40,41 through grip openings 25,26 and drawing the sleeve toward front end wall 16. This action is depicted in FIG. 8.

As the sleeve is drawn forward, the panel ribs 43,44 will ride up out of corresponding serrations 45,46 and move forward until the inherent resilience of the side panels causes them to return to a non-deflected state. This will result in the reengagement of the panel ribs into the next set of serrations. This sequence is illustrated in FIGS. 6 and 7. The above movements may continue until forward ends 36 of the sleeve panels engage front end wall 16.

In the case of consumable items such as wrapped candy, wrapped pharmaceutical items, cigarettes, etc., the space required to contain discardable wrappers, ashes or cigarettes butts from an entire package, is not equal to the original package volume. Therefore, a complete collapse of the entire package is not required to provide room in the waste compartment for the discarded materials. Thus, the final volume of the waste compartment need not be equal to the original volume of the package receptacle area.

For general use, the container of the invention is most economically constructed of a thermoplastic materials. However, when the container is used in association with cigarettes, the materials of construction should be fireproof. Metals and some types of plastic such as Teflon are examples of suitable materials. Alternatively, fire-resistant plastics could be used provided that all inside surfaces of the waste compartment are covered with a metal liner or other fireproof material.

From the above, it can be seen that the invention comprises a unique container that dynamically interacts with a collapsible package wherein the contents of the package may be consumed and waste parts of the consumable items may be stored within the container itself. Further, it can be seen that as the package contents are consumed, the area for disposal is enlarged within the size constraints of an outer housing—the dimensions of which do not need to be much larger than the package itself. This is a significant advantage over the prior art and facilitates use of the invention to a greater extent than prior art devices. This, in turn, will result in less litter, a cleaner environment and less likelihood of fires.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiments, but only by the scope of the appended claims.

I claim:

1. A container for a collapsible package comprising:

a housing having an open top and an interior defined by opposing sidewalls interconnected with opposing end walls and a bottom wall;

a partition mounted within said housing having transport means for moving said partition to predetermined positions between said end walls, said partition dividing said interior into a waste compartment and a package receptacle area, said transport means comprising opposing side panels which are interconnected with said partition and a bottom panel to form a package sleeve that extends into said package receptacle area; and, a movable cover overlying at least a potion of said top and enclosing said waste compartment.

2. The container of claim 1 wherein said partition includes retention means for releasably holding the partition at predetermined positions within said housing interior.

3. The container of claim 2 wherein said retention means comprises serrations in said housing interior on said opposing sidewalls.

4. The container of claim 1 wherein said cover includes a waste opening providing access to said waste compartment; and, a lid removably enclosing said waste opening.

5. The container of claim 1 wherein each opposing side wall includes a grip opening adjacent said package receptacle area, said transport means including a grip member extending outwardly from each respective side panel into a corresponding grip opening.

6. The container of claim 1 wherein said partition includes a package abutment means for engaging a package to be contained within said receptacle area.

7. The container of claim 6 wherein said abutment means includes a projection part extending into said package receptacle area.

8. The container of claim 3 wherein said retention means comprises panel ribs extending outwardly from said side panels for engagement with said serrations.

9. A container for a package of cigarettes comprising:

a housing with an open top having opposing sidewalls connected by opposing front and back end walls and a bottom wall:

a sleeve movably positioned within said housing comprising a partition interconnected with a bottom panel and opposing side panels, said partition having an outer face and an inner face;

said sleeve forming a waste compartment between the outer face of said partition and said front end wall and a cigarette package receptacle area between the inner face of said partition and said back end wall;

said side panels having a predetermined width less than the width of said cigarette package; and, a movable cover connected to said housing enclosing at least that portion of said open top corresponding to said waste compartment.

10. The cigarette container of claim 9 wherein said sleeve includes retention means for releasably securing said sleeve at predetermined positions between said front and back end walls.

11. The container of claim 9 wherein said sleeve includes grip means to facilitate manual movement of said sleeve.

12. The container of claim 9 wherein said partition inner face includes an abutment means for engaging said cigarette package.

13. The container of claim 9 wherein at least the outer face of said partition, said front end wall, said bottom wall and said opposing side walls are fireproof.

14. The container of claim 9 including a waste opening extending through said cover to provide access to said waste compartment; and, a lid removably overlying said waste opening.

15. The container of claim 11 wherein each opposing sidewall includes a grip opening adjacent said package receptacle area, said grip means including a grip member extending outwardly from a respective sidewall into a corresponding grip opening.

16. A container comprising:

a housing with an open top having opposing sidewalls connected by opposing front and back end walls and a bottom wall;

a partition having an outer face and an inner face including transport means for moving said partition toward and away from said front and back end walls comprising opposing side panels which are interconnected with said partition and a bottom panel to form a package sleeve;

said partition forming a waste compartment between said outer face and said front end wall and a receptacle area between said inner face and said back end wall; and, a movable cover overlying at least that portion of said open top corresponding to said waste compartment.

17. A container for a collapsible package comprising:

a housing having an open top and an interior defined by opposing sidewalls interconnected with opposing end walls and a bottom wall; and, a partition mounted within said housing dividing said interior into a waste compartment and a package receptacle area, said partition including a transport means for moving said partition to fore and aft positions relative to said end walls and including an abutment means for engaging said collapsible package, said transport means comprising opposing side panels which are interconnected with said partition and a bottom panel to form a package sleeve.

* * * * *